US007415232B2

(12) United States Patent
Matsui et al.

(10) Patent No.: US 7,415,232 B2
(45) Date of Patent: Aug. 19, 2008

(54) IMAGE FORMING APPARATUS INCLUDING FEATURE FOR REDUCING WRINKLES IN AN INTERMEDIARY TRANSFER BELT

(75) Inventors: Norio Matsui, Mishima (JP); Yoshihiro Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/924,987

(22) Filed: Aug. 25, 2004

(65) Prior Publication Data

US 2005/0078988 A1 Apr. 14, 2005

(30) Foreign Application Priority Data

Aug. 29, 2003 (JP) ..... 2003-307157

(51) Int. Cl.
*G03G 15/01* (2006.01)

(52) U.S. Cl. ..... 399/302; 399/121; 399/303

(58) Field of Classification Search ..... 399/302, 399/121, 303
See application file for complete search history.

(56) References Cited

U.S. PATENT DOCUMENTS

| | | | | |
|---|---|---|---|---|
| 4,853,741 | A | 8/1989 | Ku | 355/300 |
| 5,923,938 | A * | 7/1999 | Enomoto et al. | 399/303 |
| 6,078,766 | A * | 6/2000 | Kurotaka | 399/165 |
| 6,160,978 | A | 12/2000 | Tsuruoka et al. | 399/165 |
| 6,236,828 | B1 * | 5/2001 | Munenaka et al. | 399/303 |
| 2002/0085864 | A1 * | 7/2002 | Abe | 399/299 |
| 2002/0118982 | A1 * | 8/2002 | Fuma | 399/329 |
| 2002/0181976 | A1 * | 12/2002 | Takahata et al. | 399/302 |
| 2003/0035661 | A1 | 2/2003 | Kabata et al. | 399/162 |
| 2003/0206758 | A1 * | 11/2003 | Yasui et al. | 399/329 |

FOREIGN PATENT DOCUMENTS

| | | |
|---|---|---|
| EP | 0 856 783 A2 | 8/1998 |
| EP | 1 217 457 A2 | 6/2002 |
| JP | 1-157132 | 6/1989 |

(Continued)

OTHER PUBLICATIONS

Machine Translation of JP 2002-182494.*

(Continued)

*Primary Examiner*—David M. Gray
*Assistant Examiner*—Ryan D Walsh
(74) *Attorney, Agent, or Firm*—Fitzpatrick, Cella, Harper & Scinto

(57) ABSTRACT

An image forming apparatus includes a first stretching member, contacted to a belt member at a first contact area, for stretching the belt member; a second stretching member, contacted to a belt member at a second contact area, for stretching the belt member, wherein a plurality of transfer areas is disposed between the first contact area and the second contact area which are adjacent to each other, and the plurality of transfer areas include a first transfer area which is closest to the first contact area; and an abutting member for abutting the belt member at a position between the first transfer area and the first contact area. The abutting member and the first contact area are disposed downstream of the first transfer area, and the first transfer contact area is disposed downstream of the abutting member, with respect to a direction of movement of the belt.

10 Claims, 12 Drawing Sheets

FOREIGN PATENT DOCUMENTS

| | | |
|---|---|---|
| JP | 11-52759 | 2/1999 |
| JP | 11-288136 | 10/1999 |
| JP | 2000-235309 | 8/2000 |
| JP | 2001-5253 | 1/2001 |
| JP | 2001-356564 | 12/2001 |
| JP | 2002-182494 | 6/2002 |
| JP | 2002-189933 | 7/2002 |
| WO | WO 2-056118 A1 | 7/2002 |

OTHER PUBLICATIONS

Machine Translation of JP 11052759.*
Patent Abstracts of Japan, Publication No. 2000-187428, Jul. 4, 2000.
Patent Abstracts of Japan, Publication No. 11052759, Feb. 26, 1999.
Patent Abstracts of Japan, Publication No. 11288136, Oct. 19, 1999.
Patent Abstracts of Japan, Publication No. 2002182494, Jun. 26, 2002.

* cited by examiner

IMAGE FORMING APPARATUS INCLUDING FEATURE FOR REDUCING WRINKLES IN AN INTERMEDIARY TRANSFER BELT

FIELD OF THE INVENTION AND RELATED ART

The present invention relates to an image forming apparatus which comprises an image bearing member and an endless belt, and which forms an image on recording medium by transferring an image formed on the image bearing member, onto the recording medium, with the use of the endless belt.

An image forming apparatus which employs an intermediary transferring member has long been known. For example, it is structured as shown in FIG. 13(*a*). It has: four image formation stations, that is, yellow (Y), magenta (M), cyan (C), and black (Bk) color image forming stations, each of which comprises a photosensitive drum; a developing device disposed in the adjacencies of the peripheral surface of the photosensitive drum 100; and an intermediary transfer member 101, in the form of an endless belt, the outward surface of which is kept in contact with the peripheral surface of the photosensitive drum 100. In operation, as each of the photosensitive drums 100 is rotated, an unfixed image is formed on the peripheral surface of the photosensitive drum 100; in other words, four unfixed toner images different in color are formed on the peripheral surfaces of the four photosensitive drums 100, one for one. The four color toner images are sequentially and electrostatically transferred (primary transfer) in layers onto the intermediary transfer belt 101. Then, the full-color image composed of the four color toner images transferred in layers onto the intermediary transfer belt 101 is electrostatically transferred (secondary transfer) onto a recording medium, yielding a full-color copy. Incidentally, FIG. 13(*a*) shows only the cyan toner image forming station and black toner image forming station; the yellow toner forming station and magenta toner image forming station are not shown.

In an image forming apparatus of this type, the four toner images different in color having been transferred in layers onto the intermediary transfer belt 101 are transferred all at once onto a transfer medium, making it possible to eliminate such factors that render the image formation process unstable. Therefore, it is possible to effectively prevent the occurrences of such problems that the unfixed color toner images are disturbed while they are transferred in layers, and that color deviation occurs as the unfixed color toner images are transferred in layers, or the like problems.

However, an image forming apparatus, in accordance with the prior art, which comprised the intermediary belt 101 suffered from the following problems.

The majority of the intermediary transfer belts 101 are in the form of an endless belt, and are formed of semiconductive rubber or resin (polyimide, polycarbonate, PVDF, etc.). The toner images different in color formed in the four image forming stations can be transferred in layers onto the intermediary transfer belt 101 by circularity driving the intermediary transfer belt 101 in the form of an endless belt with the use of a driver roller while providing the belt 101 with an appropriate amount of tension.

The intermediary transfer belt 101 formed of rubber, resin, or the like is characterized in that the amount by which it is stretched by the application of a predetermined amount of tension is greater than the amount by which an intermediary transfer belt 101 formed of metal or the like. Thus, when the intermediary transfer belt 101 is circularly driven by a driver roller, the surface of the belt 101 sometimes sustains streaky deformation, in the range in which tensile force applies to the belt 101. This phenomenon is particularly conspicuous in the case of an image forming apparatus, the intermediary transfer belt 101 of which is formed of resin.

FIG. 13(*b*) shows the state of the surface of the portion of the intermediary transfer belt, in the range in which tensile strain applies to the intermediary transfer belt 101. As will be evident from the drawing, a substantial number of wrinkles are extending upstream, in terms of the circulating direction of the belt 101, from the portion of the belt 101, which is about to be wrapped around the driver roller 102. If the streaky deformation of the belt 101 reaches the image forming station, the portion of the belt 101 in the so-called nip, that is, the contact area between the photosensitive drum 100 and belt 101 (which is imaginarily indicated by broken lines in FIG. 13(*b*): black image forming station nip Lb and cyan image forming station nip Lc), becomes wavy in the direction parallel with the lengthwise direction of the nips, created thereby gaps between the photosensitive drum 100 and intermediary transfer belt 101. As a result, a defective image is yielded.

It was confirmed by the results of the tests carried out by the inventors of the present invention in order to observe the effects of these wrinkles, that the effects of the wrinkles were particularly conspicuous at the black toner image forming station, or the last image forming station, in terms of the moving direction of the intermediary transfer belt 101. More specifically, not only is a defective black image formed in the black image forming station, but also, the images formed in the upstream image forming stations, for example, magenta and cyan image forming stations, are disturbed in the black image forming station. As a result, a defective image, that is, an image defective in that it has a striped pattern which is effected by the difference in density between the portions of the image transferred onto the peak portions of the wrinkled intermediary transfer belt 101, and the portions of the image transferred onto the valley portions of the wrinkled intermediary transfer belt 101, and which extend in the direction in which a transfer medium is conveyed.

SUMMARY OF THE INVENTION

The present invention was made in consideration of the above described problem, and its primary object is to provide an image forming apparatus capable of preventing the wrinkles which occurs in its intermediary transfer belt or transfer medium conveying belt, from effecting image defects.

According to an aspect of the present invention, there is provided an image forming apparatus comprising an image bearing member for carrying toner; a rotatable endless belt member for transferring the toner from said image bearing member onto a transfer material; a plurality of transfer means for constituting a plurality of transfer areas and for supplying to said belt member electric charge for transferring the toner from said image bearing member onto a transfer material; first stretching means, contacted to said belt member at a first contact area, for stretching said belt member; second stretching means, contacted to said belt member at a second contact area, for stretching said belt member, wherein said plurality of transfer areas is disposed between the first contact area and the second contact area which are adjacent to each other, and said plurality of transfer areas include a first transfer area which is closest to said first contact area; and abutting means for abutting to said belt member at a position between said first transfer area and said first contact area; wherein said abutting means is bulged in a direction from an inside of said belt member toward outside thereof at least partly only inside a widthwise range of said first contact area with respect to a peripheral moving direction of said belt member.

According to an aspect of the present invention, there is provided an image forming apparatus comprising an image bearing member for carrying toner; a rotatable endless belt member for transferring the toner from said image bearing member onto a transfer material; transfer means for constituting a transfer area and for supplying to said belt member electric for transferring the toner from said image bearing member onto a transfer material; first stretching means, contacted to said belt member at a first contact area, for stretching said belt member; second stretching means, contacted to said belt member at a second contact area, for stretching said belt member, wherein said transfer area is disposed between said first contact area and said second contact area which are adjacent to each other with respect to a circumferential direction of said belt member as a single transfer area therebetween; and abutting means for abutting to said belt member at a position between said transfer area and said first contact area, wherein said abutting means is bulged in a direction from an inside of said belt member toward outside thereof at least partly only inside a widthwise range of said contact area with respect to a peripheral moving direction of said belt member.

According to an aspect of the present invention, there is provided an image forming apparatus comprising an image bearing member for carrying toner; a plurality of transfer means for constituting a plurality of transfer areas and for supplying to said belt member electric charge for transferring the toner from said image bearing member onto a transfer material; first stretching means, contacted to said belt member at a first contact area, for stretching said belt member; second stretching means, contacted to said belt member at a second contact area, for stretching said belt member; wherein said plurality of transfer areas is disposed between the first contact area and the second contact area which are adjacent to each other, and said plurality of transfer areas include a first transfer area which is closest to said first contact area; and a plurality of abutting means for abutting to said belt member at a position between said first transfer area and said first contact area; wherein said plurality of abutting means are disposed in a line in a direction substantially perpendicular to a peripheral moment direction of said belt member, and wherein said abutting means is bulged in a direction from an inside of said belt member toward outside thereof at least partly only inside a widthwise range of said first contact area with respect to a peripheral moving direction of said belt member, and said plurality of abutting means are bulged in a direction from an inside of said belt member toward outside thereof at least partly only inside a widthwise range of said first contact area with respect to a peripheral moving direction of said belt member.

According to an aspect of the present invention, there is provided an image forming apparatus, comprising an image bearing member for carrying toner; a rotatable endless belt member for transferring the toner from said image bearing member onto a transfer material; transfer means for constituting a transfer area and for supplying to said belt member electric for transferring the toner from said image bearing member onto a transfer material; first stretching means, contacted to said belt member at a first contact area, for stretching said belt member; second stretching means, contacted to said belt member at a second contact area, for stretching said belt member; wherein said transfer area is disposed between said first contact area and said second contact area which are adjacent to each other with respect to a circumferential direction of said belt member as a single transfer area therebetween; and a plurality of abutting means for abutting to said belt member at a position between said transfer area and said first contact area; wherein said plurality of abutting means are disposed in a line in a direction substantially perpendicular to a peripheral moving direction of said belt member, and wherein said abutting means is bulged in a direction from an inside of said belt member toward outside thereof at least partly only inside a widthwise range of said first contact area with respect to a peripheral moving direction of said belt member, and said plurality of abutting means are bulged in a direction from an inside of said belt member toward outside thereof at least partly only inside a widthwise range of said first contact area with respect to a peripheral moving direction of said belt member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

Figure 1:
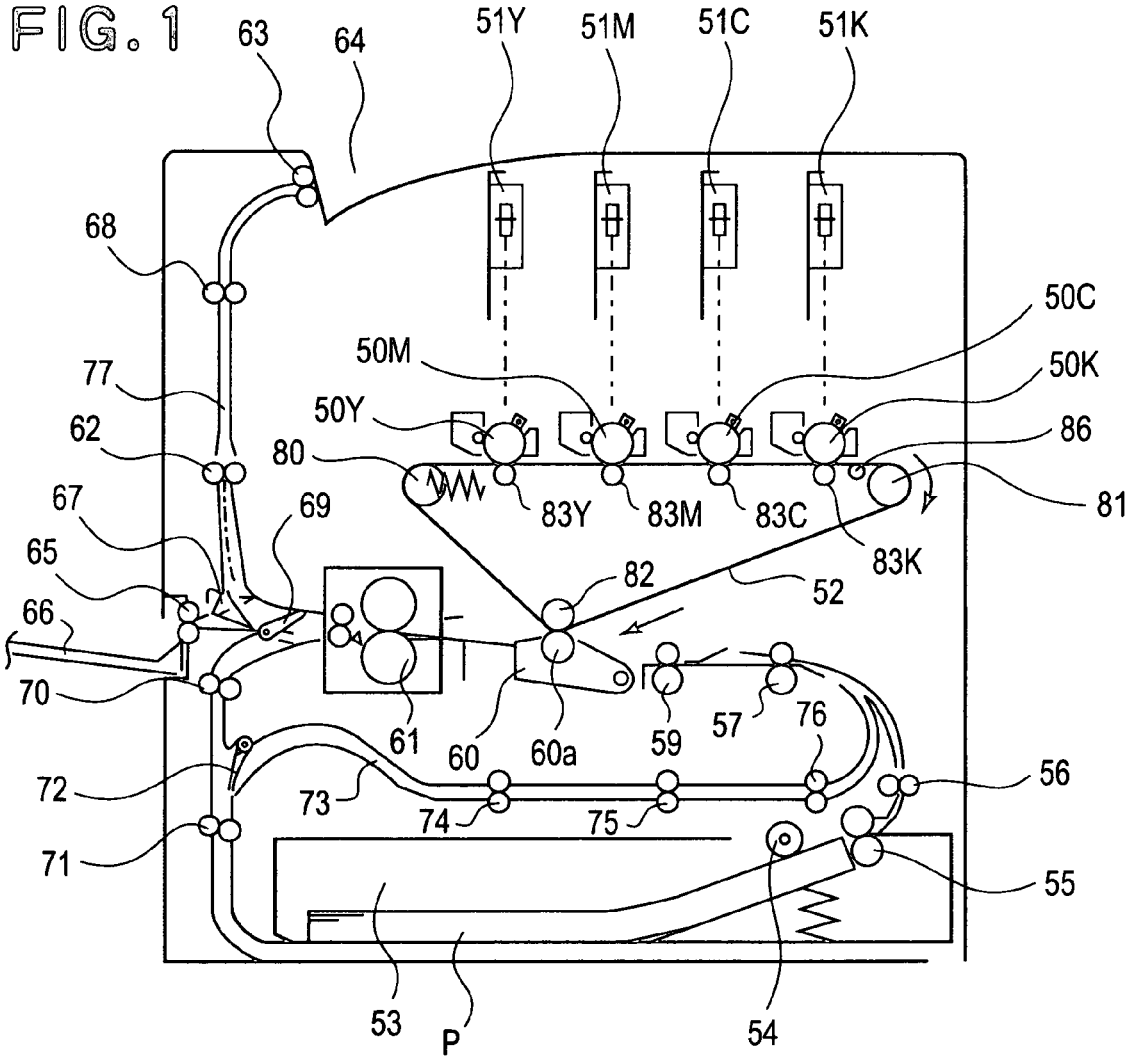
FIG. 1 is a sectional view of the image forming apparatus in the first embodiment of the present invention, depicting the structure thereof.

FIG. 1 is a sectional view of the image forming apparatus in this embodiment. First, the general structure of the image forming apparatus will be described.

(General Structure)

FIG. 1 shows an example of a full-color laser printer which employs four photosensitive drums and an intermediary transfer belt. Referential symbols 50Y, 50M, 50C, and 50Bk stand, one for one, for four electrophotographic photosensitive members as image bearing members in the form of a drum. They are integral parts of four image formation stations, which contain the yellow (Y), magenta (M), cyan (C), and black developers (toners), respectively, and which are arranged in the listed order counting from the right-hand end in the drawing.

The peripheral surfaces of the photosensitive drums 50Y, 50M, 50C, and 50Bk are exposed by beams of laser light projected from laser scanners 51Y, 51M, 50C, and 50Bk, respectively, while being modulated with the image data from an unshown image data input portion. As a result, four electrostatic latent images are formed on the peripheral surfaces of the photosensitive drums 50Y, 50M, 50C, and 50Bk. The four electrostatic latent images are developed by the yellow, magenta, cyan, and black toners, respectively. As a result, yellow, magenta, cyan, and black toner images are formed on the peripheral surfaces of the photosensitive drums 50Y, 50M, 50C, and 50Bk, respectively.

Designated by a referential number 52 is an intermediary transfer member in the form of an endless belt, or intermediary transfer belt. The intermediary transfer belt 52 is stretched around the belt suspending-tensioning means comprising a driver roller 81 (which circularly drives intermediary transfer belt 52), a tension roller 80 (which is kept pressured outward of intermediary transfer belt loop to provide intermediary transfer belt 52 with tension), and a counter roller 82 against which a secondary transfer roller is kept pressed. The intermediary transfer belt 52 is circularly driven in the direction indicated by an arrow mark in FIG. 1. The belt suspending-tensioning means are in contact with the inward surface of the intermediary transfer belt 52, in terms of the loop formed by the intermediary transfer belt 52, creating contact areas of a predetermined size and providing the internal transfer belt 52 with a predetermined amount of tension. Within the loop of the intermediary transfer belt 52, primary transfer rollers 83Y, 83M, 83C, and 83Bk for transferring the toner images formed on the peripheral surfaces of the photosensitive drums 50Y, 50M, 50C, and 50Bk are located between the driver roller 81 and tension roller 80. The primary transfer rollers 83Y, 83M, 83M, and 83Bk are kept pressed against the peripheral surfaces of the photosensitive drums 50Y, 50M, 50C, and 50Bk, with the intermediary transfer belt 52 kept pinched between the primary transfer rollers 83Y, 83M, 83C, and 83Bk, and photosensitive drums 50Y, 50M, 50C, and 50Bk, respectively (primary transfer rollers 83Y, 83M, 83C, and 83Bk are in contact with inward surface of intermediary transfer belt 52). The primary transfer rollers 83Y, 83M, 83C, and 83Bk are for supplying between themselves and the recording medium (primary transfer rollers 83) the electric charge for transferring the toner images on the photosensitive drums 50Y, 50M, 50C, and 50B, onto the intermediary transfer belt 52. More specifically, as electric charge is supplied by the primary transfer rollers 83Y, 83M, 83C, and 83Bk, the toner images, different in color, formed on the peripheral surfaces of the photosensitive drums 50Y, 50M, 50C, and 50Bk are sequentially transferred (primary transfer) onto the intermediary transfer belt 52.

In a feeder cassette 53, a certain number of sheets. P as transfer mediums are stored in layers. The sheets P are fed out of the feeder cassette 53 by the feed roller 54, into the main assembly of the image forming apparatus, and are conveyed by the combination of a feed roller and a retard roller and the combination of conveyer rollers 56 and 57 to a pair of registration rollers 59, which are intermittently driven.

If a given sheet P is fed out askew, it is straightened by the pair of registration rollers 59 as it is made to nudge against the pair of registration rollers 59. Then, the sheet P is released by the pair of registration rollers 59 with predetermined timing so that it is delivered to the secondary transfer station 60, in which the toner images on the intermediary transfer belt 52 are transferred onto the sheet P by the secondary transfer roller 60*a*. After the transfer, the sheet P is conveyed by the secondary transfer roller 60*a* and intermediary transfer belt 52 to a fixing device 61, in which the toner images are fixed.

If a "face-down command", that is, a command for discharging a sheet P so that the image bearing surface of the sheet P will face upward as it is discharged from the apparatus main assembly, is issued, the flapper 67 is moved by an unshown controlling means and driving means, into the position outlined by a solid line in the drawing. With the flapper 67 being in the above described position, the sheet P is moved on the top side of the flapper 67 after being moved through the fixing device 61. Then, it is conveyed further by the pair of discharge rollers 62 into the conveyance path 77, which has a pair of discharge rollers 68 and a pair of discharge rollers 69. Then, it is conveyed further by the pair of discharge rollers 68 through the conveyance path 77, and is discharged (in layers) by the pair of discharge rollers 69 into the delivery tray 64, with its image bearing surface facing downward.

If a "face-up command", that is, a command for discharging a sheet P so that the image bearing surface of the sheet P will face upward as it is discharged from the apparatus main assembly, is issued, the flapper 67 is moved by an unshown controlling means and driving means, into the position outlined by a dotted line. With the flapper 67 being in the above described position, the sheet P is moved on the under side of the flapper 67 after being moved through the fixing device 61. Then, it is discharged (in layers) by the pair of discharge rollers 65 into the delivery tray 66, with its image bearing surface facing upward.

When consecutively forming an image on the back side of a sheet P after forming an image on the front side of the sheet P, the flapper 69 is operated by the unshown controlling means and driving means so that the sheet P is moved past a pair of conveyance rollers 70, and then, is reversed in the conveyance direction by a pair of conveyance direction reversing rollers 71. Then, the sheet P is guided into the two-sided printing mode path 73 (back side printing mode path) by operating a flapper 72. Then, the sheet P is conveyed through the two-sided printing mode path with the use of three pairs of two-sided print mode conveyance rollers 74, 75, and 76, and the conveyer roller 57, to the pair of registration rollers 56, being thereby straightened if it is delivered askew thereto. Then, the sheet P is delivered, with a predetermined timing, to the secondary transfer station 60, in which the toner images on the intermediary transfer belt 52 are transferred onto the back side of the transfer medium P. Then, the recording medium P is conveyed by the secondary transfer roller 60*a* of the secondary transferring apparatus 60 and the intermediary transfer belt 52 to a fixing device 61, in which the toner images are fixed to the back side of the sheet P. Thereafter, the sheet P is further conveyed, and is discharged into the delivery tray 64 or 66.

The image forming apparatus in this embodiment structured as described above and employing one of the intermediary transfer systems is also provided with a means for pressing the intermediary transfer medium for preventing the wrinkles, which occurs in the intermediary transfer belt 52, from effecting a defective image.

(Means for Pressing Intermediary Transfer Belt)

Next, the structure of the means for outwardly pressing the intermediary transfer belt (which hereinafter may be referred to simply as "belt pressing means" or "wrinkle blocking means"), which characterizes this embodiment, will be described. As described above, the image forming apparatus in this embodiment is provided with four image forming stations for forming yellow, magenta, cyan, and black toner images, one for one, which are positioned in this order listing from the most upstream one in terms of the circulating direction of the intermediary transfer belt 52. It is also provided with a roller 86, which is a means for pressing the intermediary transfer belt 52 outward of the loop the belt 52 forms, and which is auxiliary to one of the primary transfer rollers 82. The roller 86 as the belt pressing means (wrinkle blocking means) is located on the downstream side of the image forming station for forming a black toner image, in terms of the circulating direction of the intermediary transfer belt 52, and on the upstream side of the driver roller 81 in terms of the circulating direction of the intermediary transfer belt 52. The belt pressing roller 86 is rotated by the movement of the intermediary transfer belt 52.

Figure 2:
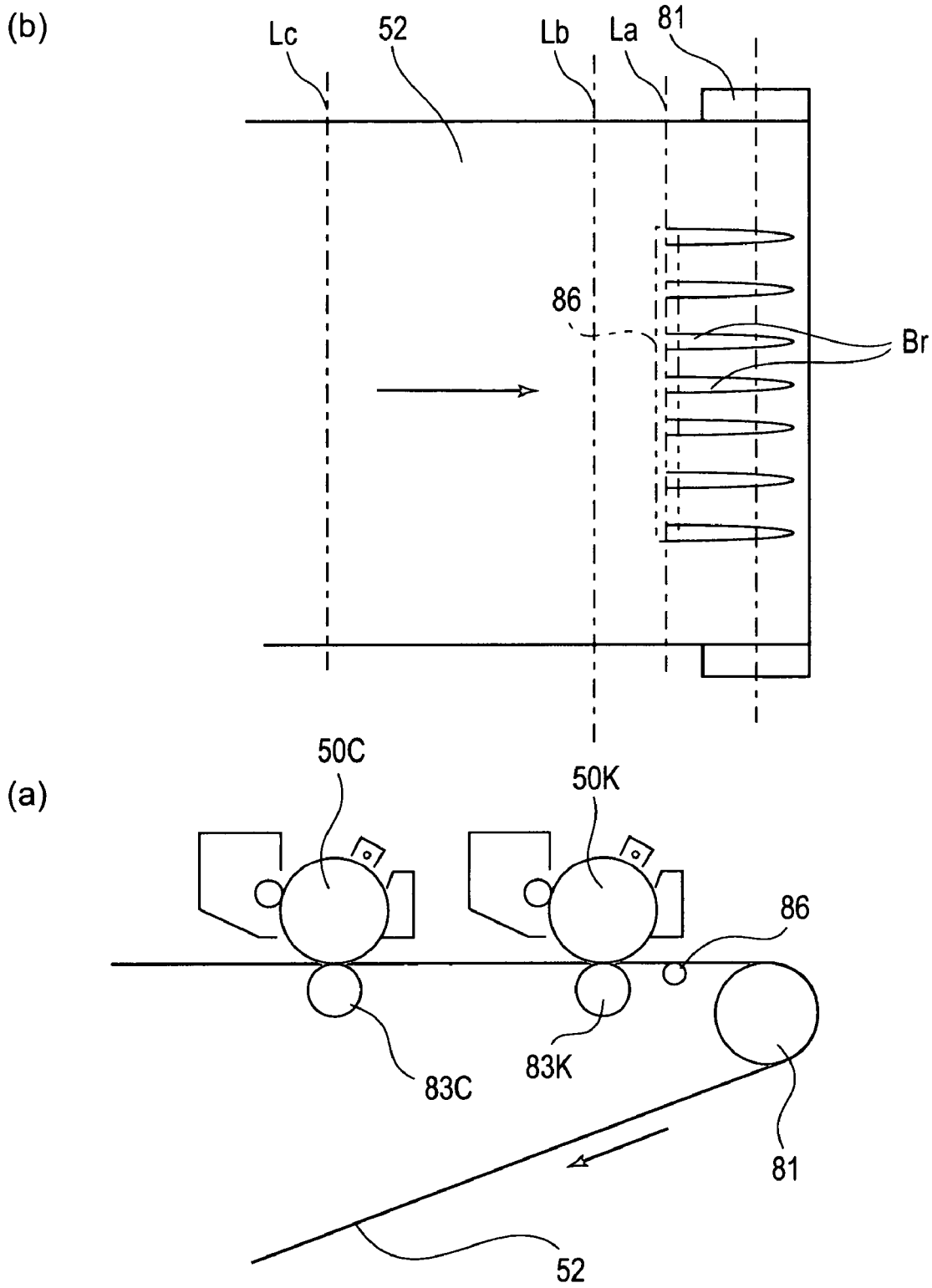
FIG. 2(*a*) is a sectional view of the cyan and black image forming stations, intermediary transfer belt, and their adjacencies, and FIG. 2(*b*) is a top plan view of the intermediary transfer belt, showing the condition thereof.

FIG. 2 shows the image forming station for forming a cyan toner image (which hereinafter will be referred to simply as cyan image forming station), the image forming station for forming a black toner image (which hereinafter will be referred to simply as black image forming station), the intermediary transfer belt 52, and their adjacencies. FIG. 2(*a*) is a sectional view, whereas FIG. 2(*b*) is a top view of the intermediary transfer belt 52, showing the manner in which the intermediary transfer belt 52 is suspended and tensioned. In terms of the direction perpendicular to the circulating direction of the intermediary transfer belt 52 (in terms of the axial direction of any of intermediary transfer belt supporting means), the portion of the belt pressing roller 86, which is actually kept pressed against the intermediary transfer belt 52, is narrower than the width of the intermediary transfer belt 52; in other words, it is narrower than the range across which a toner image is transferable onto or from the intermediary transfer belt 52. Thus, the portion of the intermediary transfer belt 52, across which the belt pressing roller 86 is kept pressed on the intermediary transfer belt 52 from the inward side of the loop of the intermediary transfer belt 52, slightly projects outward, in terms of the loop, compared to the peripheries of the intermediary transfer belt 52.

With the provision of the belt pressing roller 86, the wrinkles Br formed in the intermediary transfer belt 52 across the portion upstream of the driver roller 81 are prevented from extending upstream beyond the nip La between the belt pressing roller 86 and intermediary transfer belt 52. Since the wrinkles B4 are prevented by the belt pressing roller 86 from extending upstream beyond the nip La, they do not extend into the nips Lb and Lc, that is, the image transfer nips of the image forming stations, which is obvious. Therefore, the wrinkles Br which may be formed on the immediately upstream side of the driver roller 81 have no ill effects upon image formation.

The above described structural arrangement for preventing the wrinkles formed in the intermediary transfer belt 52 by the driver roller 81 or the like, that is, a part of the intermediary transfer belt suspending means, is the most effective means for preventing the wrinkles from negatively affecting image formation. However, from the standpoint of preventing the occurrence of image defects during an image transfer process, all that is necessary is to prevent the wrinkles from extending into the transfer stations, or smoothing the intermediary transfer belt 52 on the immediately upstream side of the transfer stations.

The reason why the intermediary transfer belt 52 is kept pressed outward only across the center portion thereof, in terms of the widthwise direction of the intermediary transfer belt 52, instead of across the entire range of the intermediary transfer belt 52, is that the occurrences of the wrinkles are limited to the center portion of the intermediary transfer belt 52, and therefore, all that is necessary is to make the center portion of the intermediary transfer belt 52 to slightly bulge outward to eliminate the wrinkles. In other words, the occurrences of the wrinkles are attributable to the slack of the intermediary transfer belt 52. Therefore, if the belt pressing roller 86 is made long enough to press the peripheries of the intermediary transfer belt 52, which do not wrinkle, as well as the center portion thereof, that is, the portion which wrinkles, the wrinkles cannot be effectively prevented from extending upstream beyond the belt pressing roller 86.

The distance by which the center portion of the intermediary transfer belt 52 is made to bulge outward by the belt pressing roller 86 is very slight; the so-called angle of contact between the belt pressing roller 86 and the intermediary transfer belt 52 is small. In other words, the angle which the portion of the intermediary transfer belt 52, which is immediately upstream of the belt pressing means (wrinkle blocking means) (86), and the portion of the intermediary transfer belt 52, which is immediately downstream of the belt pressing means (wrinkle blocking means) (86), is nearly 180°, which is large. On the other hand, the angle of contact at which the intermediary transfer belt 52 is wrapped around the tension roller is large. In other words, the angle between the portion of the intermediary transfer belt 52, which is immediately upstream of the tension roller, and the portion of the intermediary transfer belt 52, which is immediately downstream of the tension roller is small.

This is because if the angle of contact at which the intermediary transfer belt 52 is wrapped around the tensioning means is large, the intermediary transfer belt 52 is wrinkled across the areas immediately upstream as well as downstream of the belt suspending means.

Figure 3:
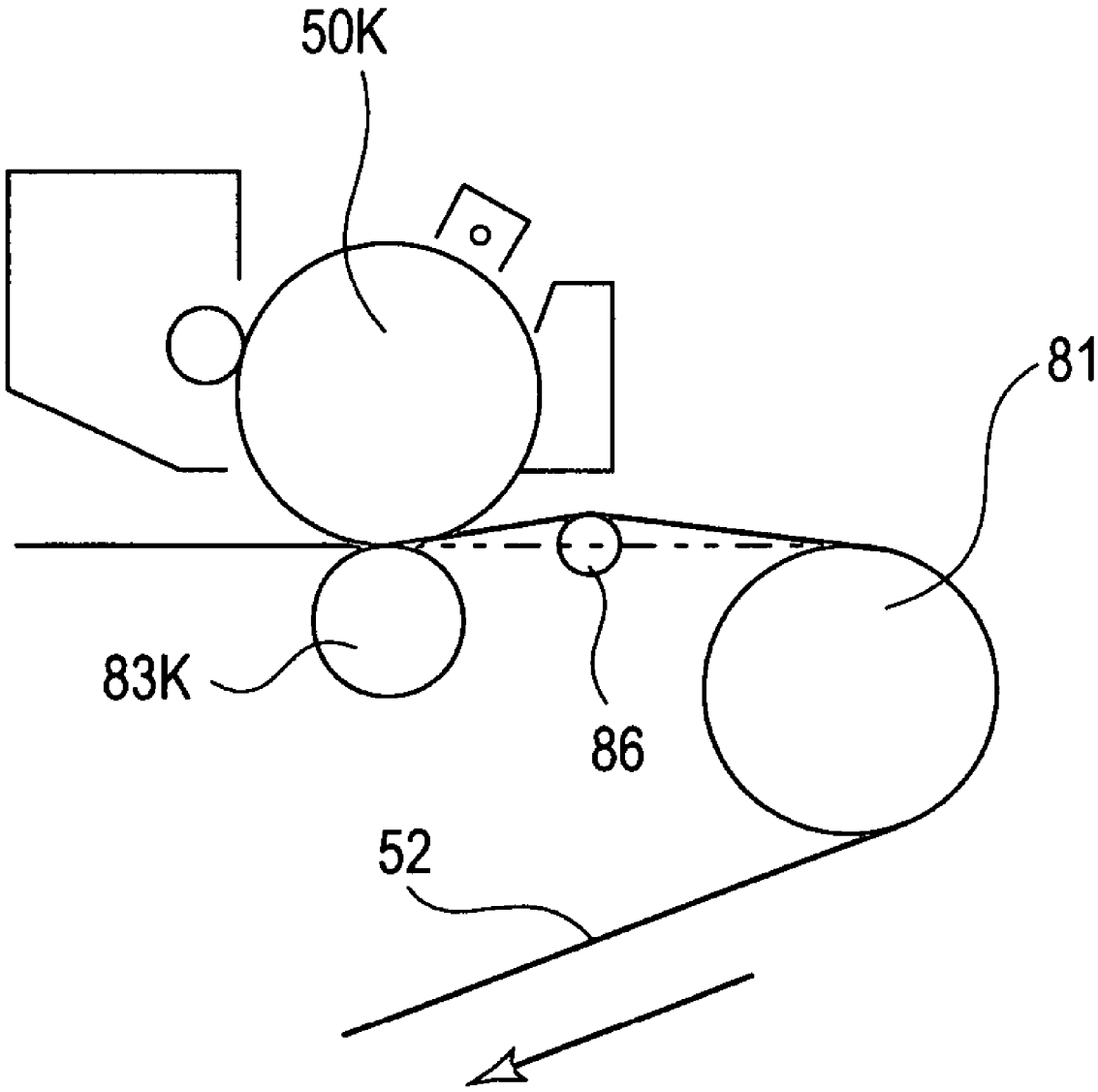
FIG. 3 is a sectional view of the belt pressing means and its adjacencies, showing the structures thereof.

FIG. 3 is an enlarged sectional view of the belt pressing means (wrinkle blocking means) (86) and its adjacencies, showing that the intermediary transfer belt 52 is slightly displaced outward across the center portion, by the belt pressing roller 86 from the position (indicated by double-dot chain line), in which the intermediary transfer belt 52 would be if it were not for the belt pressing roller 86. Incidentally, the distance by which the intermediary transfer belt 52 is displaced by the belt pressing roller 86 is slightly exaggerated in the drawing for the purpose of clearly showing the function of the belt pressing roller 86.

Figure 4:
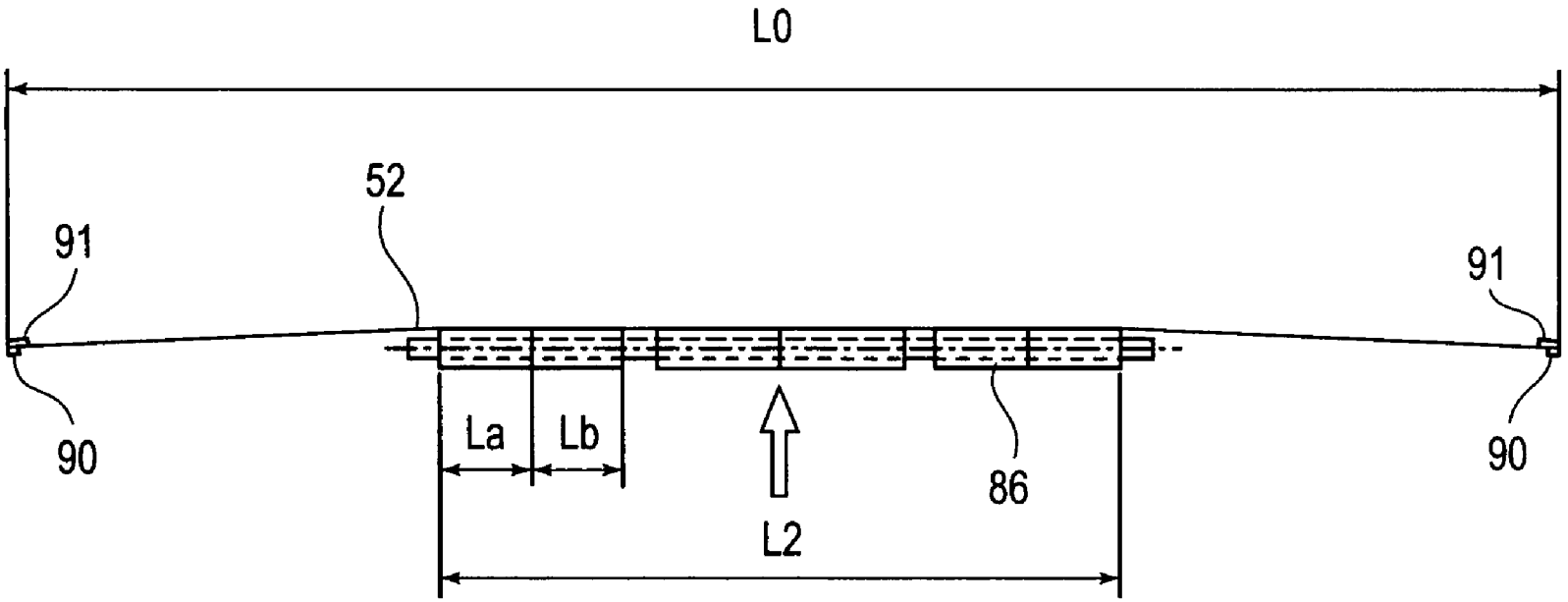
FIG. 4 is a sectional view of the intermediary transfer belt, and the belt pressing roller auxiliary to one of the primary transfer rollers and centrally located relative to the intermediary transfer belt, in terms of the widthwise direction (direction perpendicular to circulating direction belt) of the intermediary transfer belt, at a plane perpendicular to the belt and coinciding with the axial line of the belt pressing roller, showing the structures thereof.

FIG. 4 is a sectional view of the intermediary transfer belt 52 and belt pressing roller 86, at a plane perpendicular to the lengthwise direction of the intermediary transfer belt 52 (direction perpendicular to moving direction of intermediary transfer belt 52) and top surface of the intermediary transfer belt 52, showing the structure thereof.

As is evident from FIG. 4, the belt pressing means (wrinkle blocking means) (86) comprises multiple belt pressing rollers 86 (six rollers in this embodiment) for keeping the center portion of the intermediary transfer belt 52 outwardly pressed. In the drawing, L0 stands for the width of the intermediary transfer belt 52, and La, Lb, . . . , stand for the lengths of the individual rollers 86. L2 stands for the length of the center portion of the intermediary transfer belt 52, by which the intermediary transfer belt 52 is kept pressed outward by the belt pressing roller 86. With the employment of the belt pressing means (wrinkle blocking means) (86) made up of multiple belt pressing rollers 86, each of which is allowed to rotate independently from the rest, instead of a single-piece belt pressing roller 86, the adverse effect of the belt pressing means (wrinkle blocking means) (86) upon the intermediary transfer belt 52 that the belt pressing means (wrinkle blocking means) (86) tends to laterally displace the intermediary transfer belt 52 is virtually eliminated. The portion L2 of the intermediary transfer belt 52, across which the intermediary transfer belt 52 is kept pressed outward by the belt pressing rollers 86, is narrower than the width L0 of the intermediary transfer belt 52 (L0>L2), as described above. In other words, the belt pressing rollers 86 are made to contact the widthwise center portion of the intermediary transfer belt 52. Further, by making the width L2 narrower than the maximum range, in terms of the widthwise direction of the intermediary transfer belt 52, of the intermediary transfer belt 52 across which an image can be outputted on the intermediary transfer belt 52 by the image forming apparatus, it is possible to effectively eliminate the effects of the wrinkles formed in the image formation range, in terms of the widthwise direction of the intermediary transfer belt 52, upon image formation.

Some intermediary transfer belts 52 are provided with reinforcement tapes 91 attached to the lateral edges of the intermediary transfer belt 52, one for one, in order to improve the intermediary transfer belt 52 in tensile strength. Further, in order to regulate the lateral displacement of the intermediary transfer belt 52, an endless belt, which occurs when the intermediary transfer belt 52 is continuously driven for a substantial length of time, some intermediary transfer belts 52 are provided with a regulating member 60 formed of urethane or the like. It may be reasonable to say that providing the intermediary transfer belt 52 with one or both of these belt reinforcing members and displacement preventing members enhances the formation and/or extension of the wrinkles across the center portion of belt 52, because this provision makes the center portion of the intermediary transfer belt 52 different in tensile strength from the peripheral portions of the intermediary transfer belt 52.

In other words, even in the case of an image forming apparatus structured so that the center portions of its intermediary transfer belt 52 is likely to wrinkle, the wrinkles of the belt 52 are prevented from affecting the image forming station as shown in FIG. 2, by keeping the belt 52 pressured outward across the center portion in terms of the widthwise direction of the belt; image defects attributable to the belt wrinkles can be prevented. Employing rollers as the means for stretching outward the widthwise center portion of the intermediary transfer belt 52 can prevent the belt 52 from being frictionally charged by the means for outwardly stretching the center portion of the intermediary transfer belt 52, and also, can prevent the belt 52 from being braked by the belt pressing (stretching) means.

Figure 5:
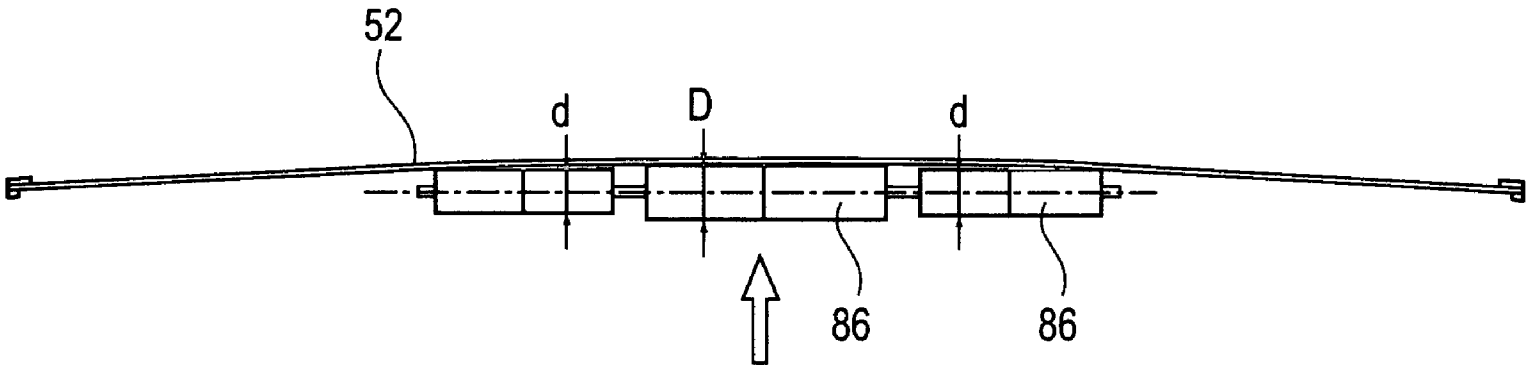
FIG. 5 is a sectional view of the intermediary transfer belt, and the belt pressing means (wrinkle blocking means) comprising multiple rollers different in diameter, auxiliary to one of the primary transfer rollers, and centrally located relative to the intermediary transfer belt, in terms of the widthwise direction (direction perpendicular to circulating direction belt) of the intermediary transfer belt, at a plane perpendicular to the belt and coinciding with the axial line of the belt pressing means (wrinkle blocking means) (rollers), showing the structures thereof.

The number of the rollers for locally stretching the intermediary transfer belt 52 does not need to be limited to six as it is in this embodiment; it may be more than six. Further, the rollers do not need to be identical in length and diameter. For example, in order to more effectively block the wrinkles from extending toward the image forming station by compensating for the fact that the literal center portion of the intermediary transfer belt 52 in terms of the widthwise direction of the intermediary transfer belt 52 is more likely to stretch than the peripheries thereof, the rollers located across the center portion of the wrinkle blocking means (belt pressing means) may be increased in diameter as shown in FIG. 5 (D>d).

Further, the rollers may be made different in the length by which they press the belt, as long as such an arrangement can effectively prevent the belt wrinkles from affecting image formation.

The plurality of the belt pressing rollers (belt pressing means, wrinkle blocking means) are desired to be equal in surface properties, such as hardness and coefficient of friction. If the rollers are different in these properties, the wrinkle blocking means may be unstable in the function of preventing the belt from laterally deviating when the belt is continuously driven; the unstableness of the wrinkle blocking means in the prevention of the belt deviation in the widthwise direction may result in the exacerbation of wrinkle formation. The rollers are desired to be no less than 25 degrees in Asker C scale, for example, in hardness. Further, the coefficient of friction of each roller is no more than 0.5 when it is measured with the use of Heidon Portable Friction Meter (muse type 94i: product of Shinto Kagaku).

At this time, the tests carried by the inventors of the present invention to study the belt pressing rollers 86 structured as shown in FIG. 4 will be described.

The effectiveness of the belt pressing rollers 86 was studied under the condition in which a substantial number of wrinkles appeared on the upstream side of the belt pressing means (wrinkle blocking means: belt pressing rollers) structured as shown in FIG. 4, and in which image defects always occurred unless the distance by which the intermediary transfer belt 52 was displaced outward of the belt loop by the belt pressing rollers 86 was greater than a certain value.

The belt pressing rollers 86 were 5 mm in diameter. In the tests, the severity of the image defects caused by the formation of the wrinkles was studied while varying the distance by which the center portion of the intermediary transfer belt 52, in terms of the widthwise direction of the intermediary transfer belt 52, was displaced by the apparent invasion of the belt pressing rollers 86, between 0.1 mm and 1 mm.

As a result, it was confirmed that as long as the distance by which the center portion of the intermediary transfer belt 52 was displaced by the apparent invasion of the belt pressing rollers 86 was no less than 0.4 mm, the image defects attributable to the wrinkling of the intermediary transfer belt 52 could be prevented.

As described above, according to this embodiment, an image forming apparatus is provided with a member for keeping the intermediary transfer belt 52 displaced a predetermined distance outward of the loop formed by the intermediary transfer belt 52, across the approximate center portion of the intermediary transfer belt 52 in terms of the widthwise direction of the intermediary transfer belt 52, and this member is positioned between the most downstream image forming station and the roller for driving the intermediary transfer belt 52. As a result, the wrinkles which occur in the intermediary transfer belt 52 because of the manner in which the intermediary transfer belt 52 is supported (suspended) by the driver roller 81 are prevented from affecting image formation. Further, it is assured that a contact area of a sufficient size is formed between the intermediary transfer belt 52 and the peripheral surface of each photosensitive drum in each image forming station. Therefore, it is possible to prevent the problem that an image suffering defects attributable to the wrinkling of the intermediary transfer belt 52 is formed on a transfer medium; it is possible to obtain a color image of high quality.

Embodiment 2

Next, the second embodiment of the present invention will be described with reference to FIG. 6. The structure of the image forming apparatus in this embodiment is virtually the same as that of the image forming apparatus in the first embodiment. Therefore, it will not be described except for the portions that characterize this embodiment.

Figure 6:
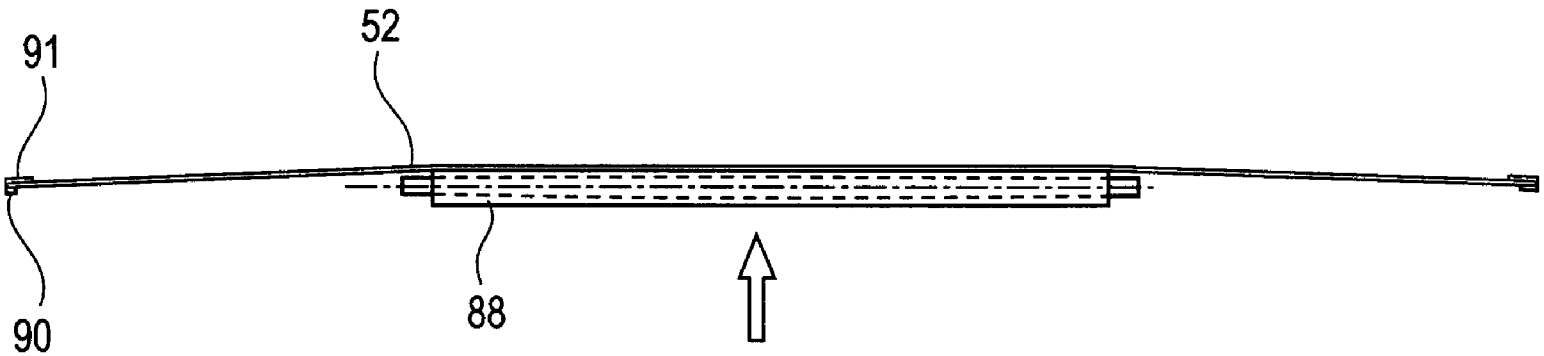
FIG. 6 is a sectional view of the intermediary transfer belt and belt pressing means (wrinkle blocking means) in the second embodiment of the present invention, showing the structure thereof.

FIG. 6 is a sectional view of the intermediary transfer belt pressing means (wrinkle blocking means) and intermediary transfer belt 52, showing the structure of the wrinkle blocking means. As will be evident from FIG. 6, a belt pressing means 88 as a belt pressing means (wrinkle blocking means), for keeping the intermediary transfer belt 52 pressed upward across the center portion of the intermediary transfer belt 52, in terms of the widthwise direction of the intermediary transfer belt 52, is a single-piece roller, the length of which is roughly half the width of the intermediary transfer belt 52. It keeps the intermediary transfer belt 52 pressed outward, across roughly the center portion of the intermediary transfer belt 52.

This roller may be metallic, as long as it is flexible enough to conform to the curvature which the intermediary transfer belt 52 forms as it is pressed outward by the roller. Such a roller can prevent the image defects attributable to the wrinkles of the intermediary transfer belt 52, in spite of its simple structure.

The intermediary transfer belt pressing roller 88 (wrinkle blocking roller) is formed of electrically conductive material. Therefore, it is grounded to prevent the following problem. That is, the intermediary transfer belt 52 is charged for image transfer. Therefore, as the belt pressing roller 88 (wrinkle blocking roller) is placed in contact with the charged intermediary transfer belt 52, it is possible, unless the belt pressing roller 88 (wrinkle blocking roller) is grounded, that the image formed on the intermediary transfer belt 52 will be disturbed by the excessive electric charge of the belt pressing roller 88 (wrinkle blocking roller).

Embodiment 3

Next, the third embodiment of the present invention will be described with reference to FIG. 7. The basic structure of the image forming apparatus in this embodiment is also the same as that in the first embodiment, and therefore, will not be described here. Instead, only the portion of the structure which characterizes this embodiment will be described.

Figure 7:
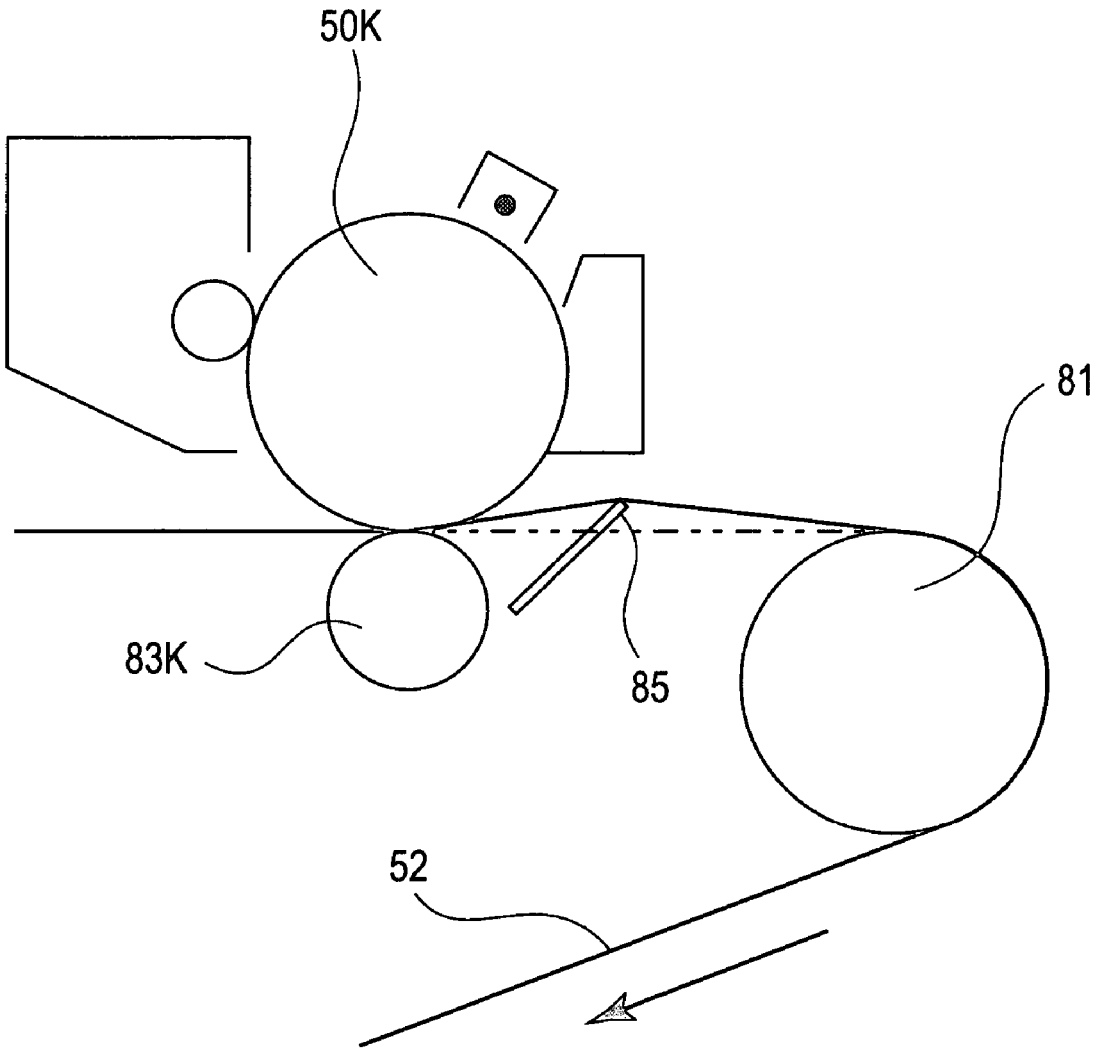
FIG. 7 is a sectional view of the intermediary transfer belt and belt pressing means (wrinkle blocking means) in the third embodiment of the present invention, showing the structure thereof.

FIG. 7 is a sectional view of the belt pressing means (wrinkle blocking means) in the third embodiment of the present invention, showing the structure thereof. The belt pressing means (wrinkle blocking means) in the image forming apparatuses in the preceding embodiments were in the form of a roller, and were rotated by the rotation of the intermediary transfer belt 52. The belt pressing means (85) (wrinkle blocking means) in this embodiment, however, is in the form of a blade, and is structured and positioned so that it keeps the center portion of the intermediary transfer belt 52, in terms of the widthwise direction of the intermediary transfer belt 52, slightly bulged outward from the normal path, or the path the intermediary transfer belt 52 would follow if the belt pressing roller 85 (wrinkle blocking roller) were not provided. The distance by which the intermediary transfer belt 52 is made to bulge outward, and the portion of the intermediary transfer belt 52 across which the intermediary transfer belt 52 is made to bulge outward, are the same as those in the above described preceding embodiments.

Even if the means for keeping the intermediary transfer belt 52 pressured outward is in the form of a blade such as the belt pressing blade 85 (wrinkle blocking blade) in this embodiment, the image defects attributable to the wrinkles of the intermediary transfer belt 52 can be just as effectively prevented as they can be prevented by the belt pressing means (wrinkle blocking means) in the form of a roller in the above described preceding embodiments; a color image of high quality can be obtained. Further, the employment of a blade as the belt pressing means (wrinkle blocking means) can simplify the belt pressing means (wrinkle blocking means) in structure.

Embodiment 4

Figure 8:
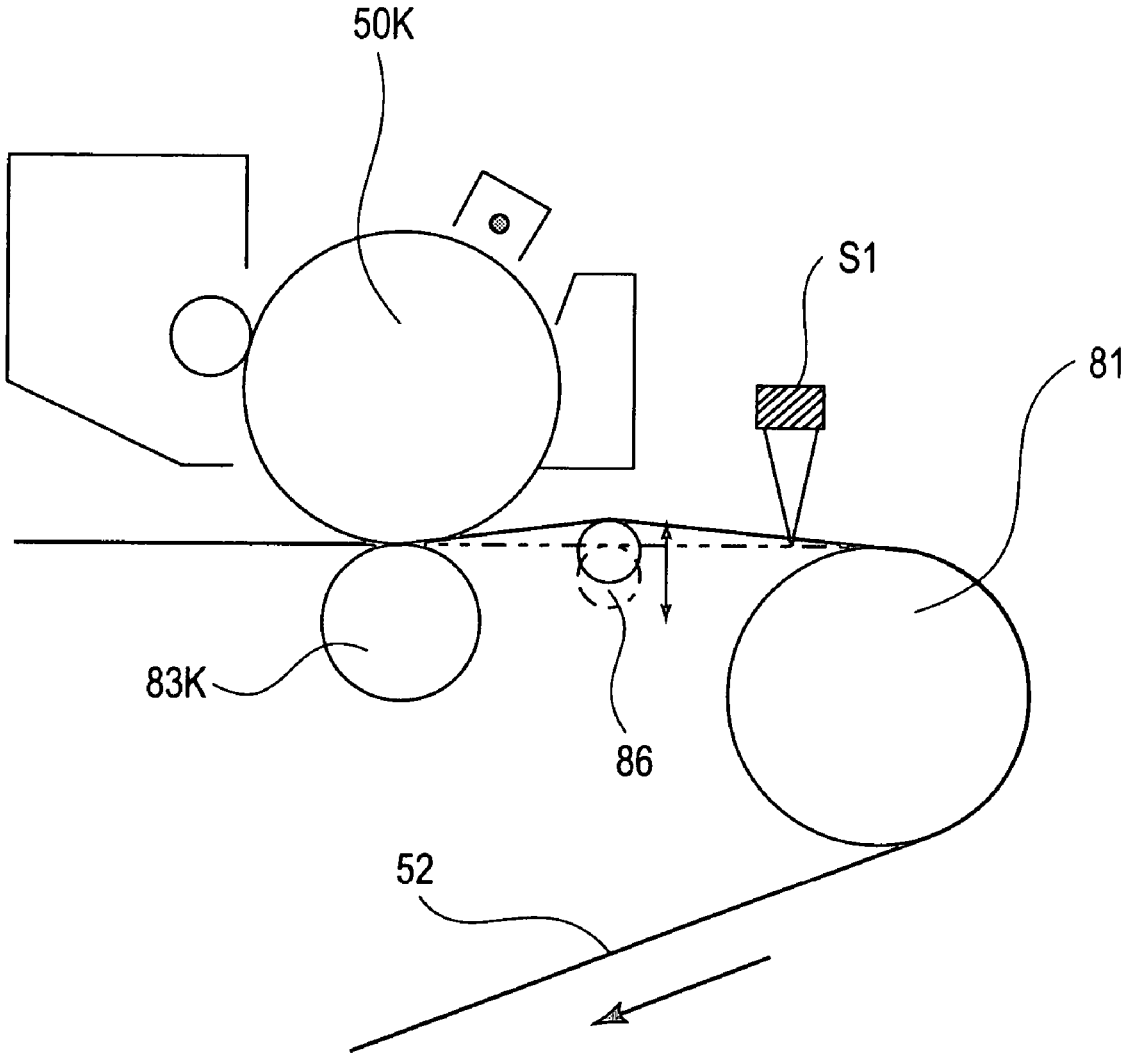
FIG. 8 is a sectional view of the intermediary transfer belt and belt pressing means (wrinkle blocking means) in the fourth embodiment of the present invention, showing the structure thereof.

Next, the fourth embodiment of the present invention will be described with reference to FIG. 8. The basic structure of the image forming apparatus in this embodiment is also the same as those in the preceding embodiments, and therefore, will not be described here. Instead, only the portion of the structure which characterizes this embodiment will be described.

FIG. 7 is a sectional view of the belt pressing means (wrinkle blocking means) in the fourth embodiment of the present invention, showing the structure thereof. It is commonplace that in order to assure a high degree of fidelity when forming an image with the use of a color image forming apparatus, a color image forming apparatus is equipped with various sensors for adjustment. For example, some color image forming apparatuses are equipped with a registration sensor S1 for optically aligning the images formed in the plurality of image forming stations, as shown in FIG. 8. The structural arrangement for making adjustments for accurately aligning the plurality of toner images different in color by detecting the registration mark or the like on the intermediary transfer belt 52 with the use of registration sensor S1 has been well known, and therefore, will not be described here.

If the intermediary transfer belt 52 is pushed outward by the belt pressing roller 86 (wrinkle blocking roller) as it is in the above described first embodiment during the process for highly precisely reading image data, the angle at which the beam of light projected from the sensor S1 to read the marker or the like on the intermediary transfer belt 52 hits the surface of the intermediary transfer belt 52 becomes different from the predetermined angle at which the beam of light is to hit the surface of the intermediary transfer belt 52 if the belt 52 were not made to bulge by the belt pressing roller 86. Therefore, there is the possibility that the positions of the aforementioned registration marks, which are read while the portion of the intermediary transfer belt having the registration marks is bulged, will be different from the positions of the registration marks, which are read while the portion of the intermediary transfer belt having the registration marks is not bulged, that is, while the portion is used for image formation.

Therefore, in this embodiment, the image forming apparatus is provided with an unshown means for retracting the belt pressing roller 86 (wrinkle blocking roller), that is, a driving means for vertically moving the belt pressing roller 86 (wrinkle blocking roller), in order to prevent the angle, at which the beams of the light projected from the sensor S1 hits the surface of the intermediary transfer belt 52, from becoming different from the predetermined angle due to the displacement of the intermediary transfer belt 52 by the belt pressing roller 86 (wrinkle blocking roller), when reading the registration marks or the like with the use of the sensor S1 or the like.

With the provision of this means for retracting the belt pressing roller 86 (wrinkle blocking roller), when the image forming apparatus carries out the automatic registration adjustment process, which is independent from the image formation process, the belt pressing roller 86 (wrinkle blocking roller) is retracted to break the contact between the belt pressing roller 86 (wrinkle blocking roller) and intermediary transfer belt 52 in order to make it possible for the sensor S1 to accurately detect the registration markers or the like, whereas when the image forming apparatus is actually forming an image, the belt pressing roller (wrinkle blocking roller) 86 is moved back into the position in which it keeps the center portion of the intermediary transfer belt 52 bulged outward by a predetermined distance. Therefore, the plurality of toner images different in color are optically aligned at a high level of accuracy, making it possible to output an image of high quality.

Embodiment 5

Next, the fifth embodiment of the present invention will be described with reference to FIGS. 9 and 10. The basic structure of the image forming apparatus in this embodiment is also the same as those in the preceding embodiments, and therefore, will not be described here. Instead, only the portion of the structure which characterizes this embodiment will be described.

Figure 9:
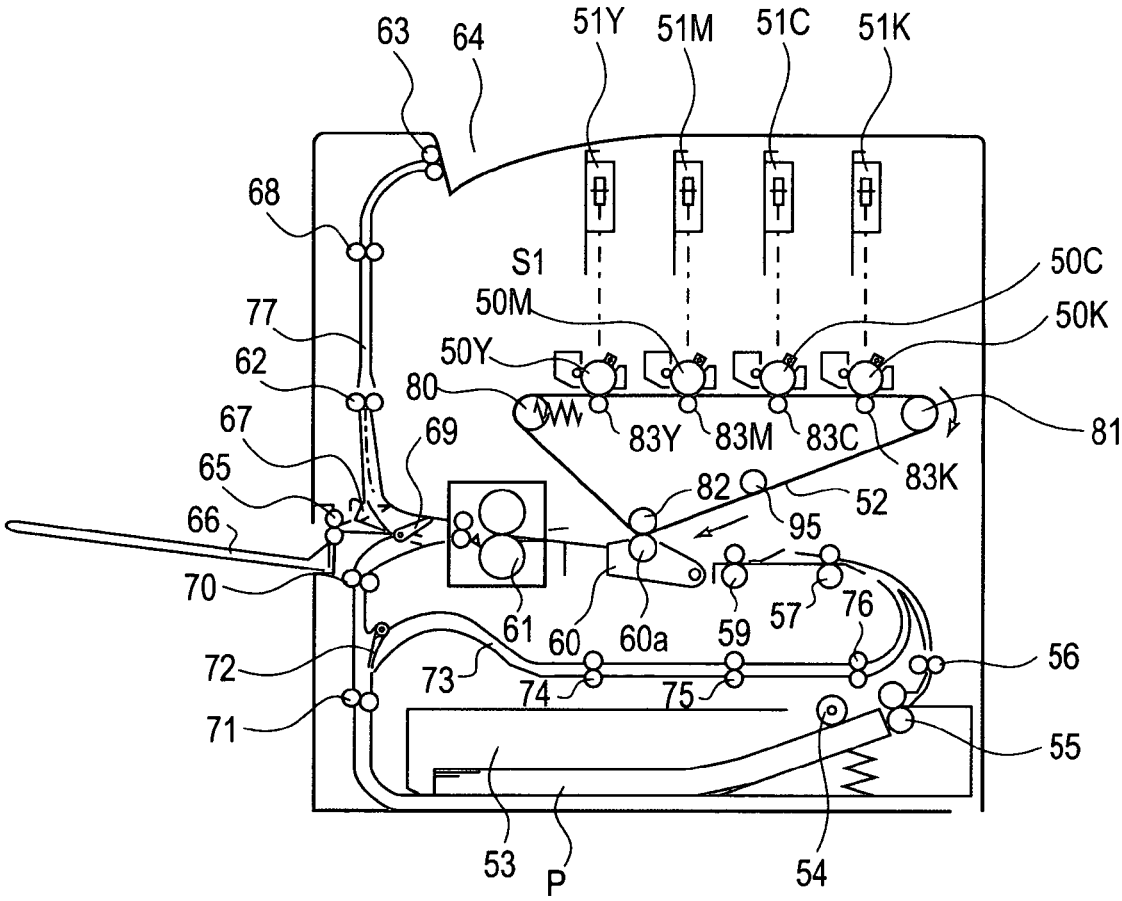
FIG. 9 is a sectional view of the image forming apparatus according to a fifth embodiment equipped with an intermediary transfer belt pressing roller auxiliary to the secondary transfer roller and centrally located relative to the belt in terms of the widthwise direction of the belt, showing the structure thereof.

FIG. 9 is a sectional view of the image forming apparatus, in the fifth embodiment which also employs an intermediary transferring member as those in the preceding embodiments, showing the general structure thereof. The image forming apparatus in this embodiment is provided with an auxiliary roller 95 for preventing the intermediary transfer belt 52 from being wrinkled in the range in which the toner images on the intermediary transfer belt 52 are transferred onto a transfer medium. This image forming apparatus is different from those in the preceding embodiments in that it is provided with the auxiliary roller 95 for preventing the intermediary transfer belt 52 from being wrinkled in the range upstream of the secondary transfer station, instead of the belt pressing roller 86 (wrinkle blocking roller) in the first embodiment. The wrinkle prevention roller 95 is located in the upstream adjacencies of the secondary transfer counter roller 82. The structure of the wrinkle prevention roller 95, the portion of the intermediary transfer belt 52 across which the roller 95 contacts the intermediary transfer belt 52, and the distance by which the intermediary transfer belt 52 is displaced by the wrinkle prevention roller 95, are made comparable to the structure of the belt pressing roller 86 (88) (wrinkle blocking roller), the portion of the intermediary transfer belt 52 across which the belt pressing roller 86 (88) (wrinkle blocking roller) contacts the intermediary transfer belt 52, and the distance by which the intermediary transfer belt 52 is displaced by the belt pressing roller 86 (88) (wrinkle blocking roller), in the preceding embodiments.

The provision of the wrinkle prevention roller 95 structured and positioned as described above can prevent the formation of a defective image, more specifically, an image with a wavy appearance, attributable the transfer of the toner images on the wavy intermediary transfer belt 52 (wrinkled intermediary transfer belt 52) onto the transfer medium. In other words, it can effectively prevent the occurrence of image defects in the secondary transfer station.

Figure 10:
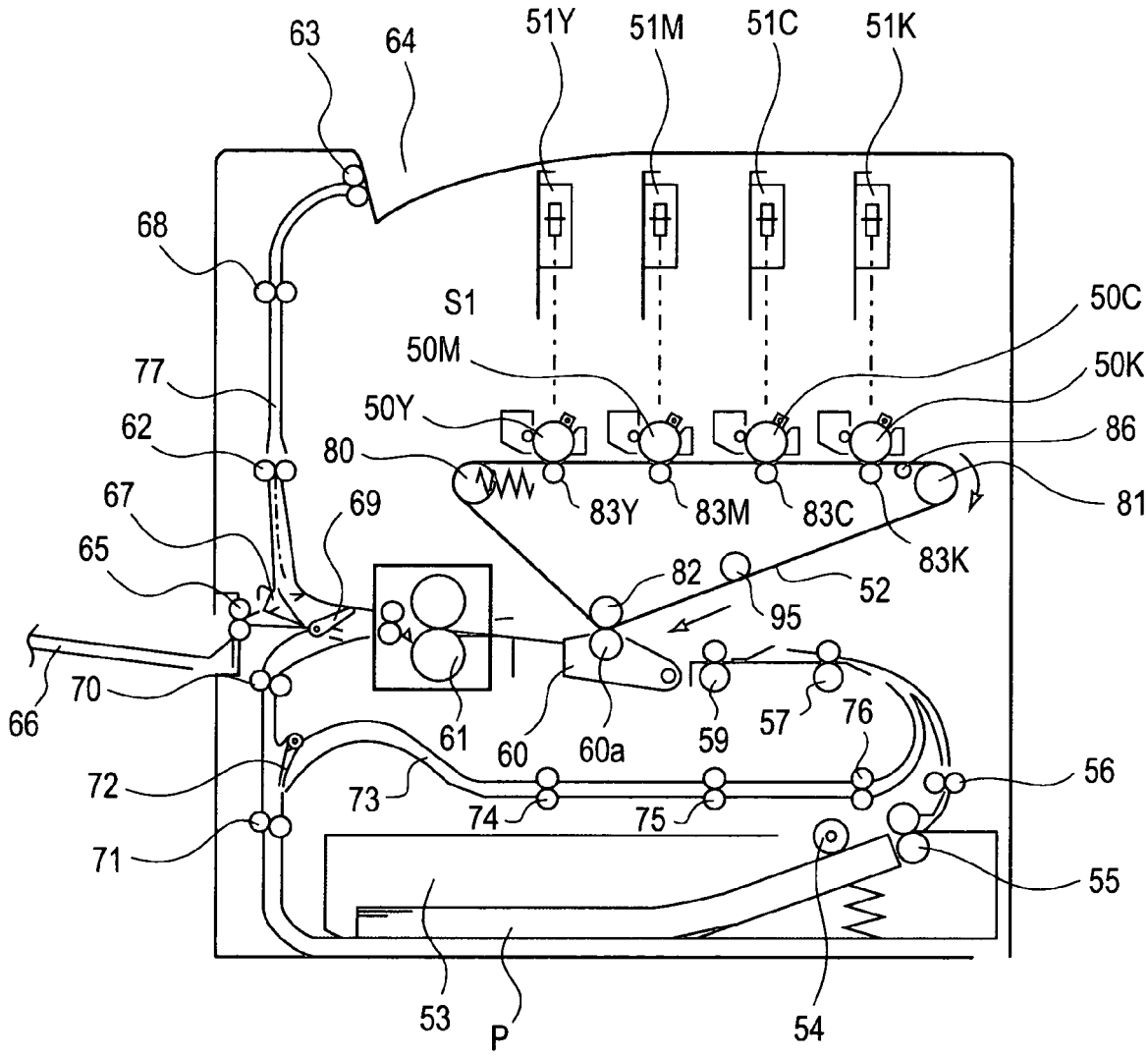
FIG. 10 is a sectional view of the image forming apparatus equipped with both the belt pressing roller auxiliary to one of the primary transfer rollers and centrally located relative to the intermediary transfer belt, in terms of the widthwise direction of the intermediary transfer belt, and the intermediary transfer belt pressing roller auxiliary to the secondary transfer roller and centrally located relative to the belt in terms of the widthwise direction of the belt, showing the structure thereof.

FIG. 10 is a sectional view of an image forming apparatus in this embodiment, which has both the belt pressing roller 86 (wrinkle blocking roller) auxiliary to the primary transfer roller, and the wrinkle prevention roller 95 auxiliary to the secondary transfer roller, depicting the structure thereof. As will be evident from FIG. 10, the belt pressing roller 86 (wrinkle blocking roller) is positioned in the downstream adjacencies of the black image forming station, and the wrinkle prevention roller 95 is positioned in the upstream adjacencies of the secondary transfer counter roller 82. Therefore, not only can the effects similar to those obtained by the image forming apparatus in the first embodiment be realized, but also, the effects similar to those obtained by the image forming apparatus in the fifth embodiment can be realized, that is, the wrinkles which would occur in the intermediary transfer belt 52 if it were not for the wrinkle prevention roller 95 will never occur. Therefore, an image of high quality can be recorded on a transfer medium.

Embodiment 6

Next, the sixth embodiment of the present invention will be described with reference to FIG. 11. The basic structure of the image forming apparatus in this embodiment is also the same as those in the preceding embodiments, and therefore, will not be described here. Instead, only the portion of the structure which characterizes this embodiment will be described.

Figure 11:
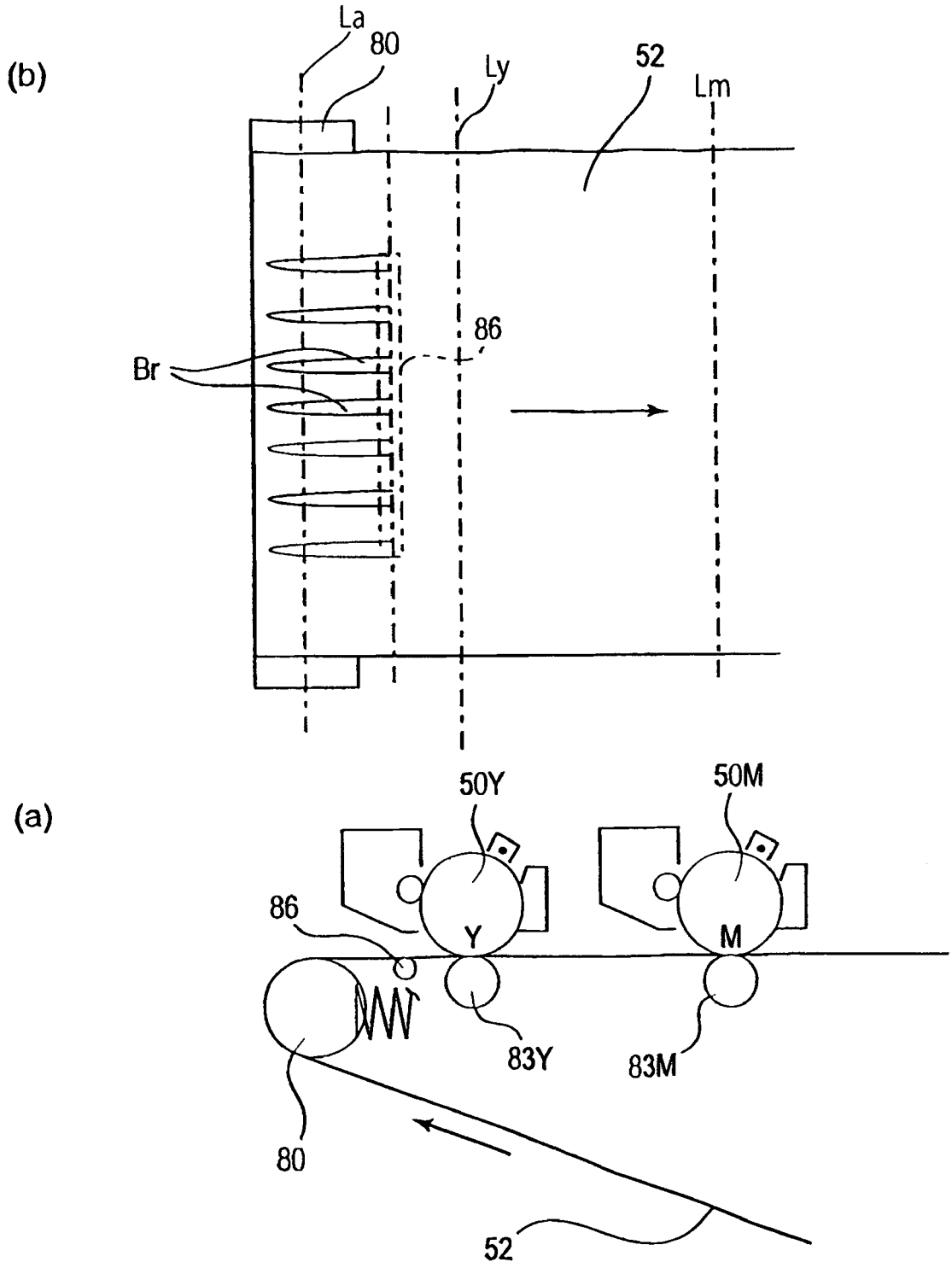
FIG. 11 is a drawing for describing the sixth embodiment of the present invention, in which the intermediary transfer belt pressing roller auxiliary to the primary transfer roller is positioned upstream of the first image forming station in terms of the intermediary transfer belt circulating direction, describing the structure thereof.

FIGS. 11(*a*) and 11(*b*) are sectional and plan views of the belt pressing roller (wrinkle blocking roller), in the sixth embodiment, which is auxiliary to the tension roller 80 and is positioned upstream of the yellow image forming station. As will be evident from FIG. 11, the belt pressing roller 86 (wrinkle blocking roller) in this embodiment is positioned on the downstream side of the tension roller 80 and on the upstream side of the yellow toner image forming station, that is, the most upstream image forming station of the four toner image forming stations. The distance by which the intermediary transfer belt 52 is displaced outward by the belt pressing roller 86 (wrinkle blocking roller), and the structure for causing the belt pressing roller 86 (wrinkle blocking roller) to keep the intermediary transfer belt 52 pressed outward across the center portion of the intermediary transfer belt 52, are made comparable to the distance by which the intermediary transfer belt is displaced outward by the belt pressing roller 86 (88) (wrinkle blocking roller), and the structure for causing the belt pressing roller 86 (88) (wrinkle blocking roller) to keep the intermediary transfer belt 52 pressed outward across the center portion of the intermediary transfer belt 52, in the preceding embodiments.

With the placement of the belt pressing roller 86 (wrinkle blocking roller) on the upstream side of the most upstream image forming station, the wrinkles Br formed on the immediately downstream side of the tension roller 80 are prevented from extending downstream beyond the nip La formed between the tension roller 80 and intermediary transfer belt 52, being therefore prevented from extending into the nip Ly and Lm of the image forming stations. In other words, the wrinkles formed in the intermediary transfer belt 52 in the immediately upstream adjacencies of the tension roller 80 are prevented from affecting image formation. Therefore, it is possible to form an image of high quality.

Incidentally, an image forming apparatus having four image forming stations may be provided with two belt pressing rollers 86 (wrinkle blocking roller) as means for keeping the intermediary transfer belt 52 pressed outward, that is, one positioned on the upstream side of the yellow toner image forming station, or the most upstream station, and the other on the downstream side of the black toner image forming station, or the most downstream image forming station. Such an arrangement makes it possible to form an image while preventing both the wrinkles attributable to the tension roller 80 and the wrinkles attributable to the driver roller 81 from affecting image formation.

Embodiment 7

Next, the seventh embodiment of the present invention will be described with reference to FIG. 12. The basic structure of the image forming apparatus in this embodiment is also the same as those in the preceding embodiments, and therefore, will not be described here. Thus, instead of repeating the same descriptions, the components in this embodiment similar in function to those in the preceding embodiments are given the same referential symbols as those given in the preceding embodiments.

Figure 12:
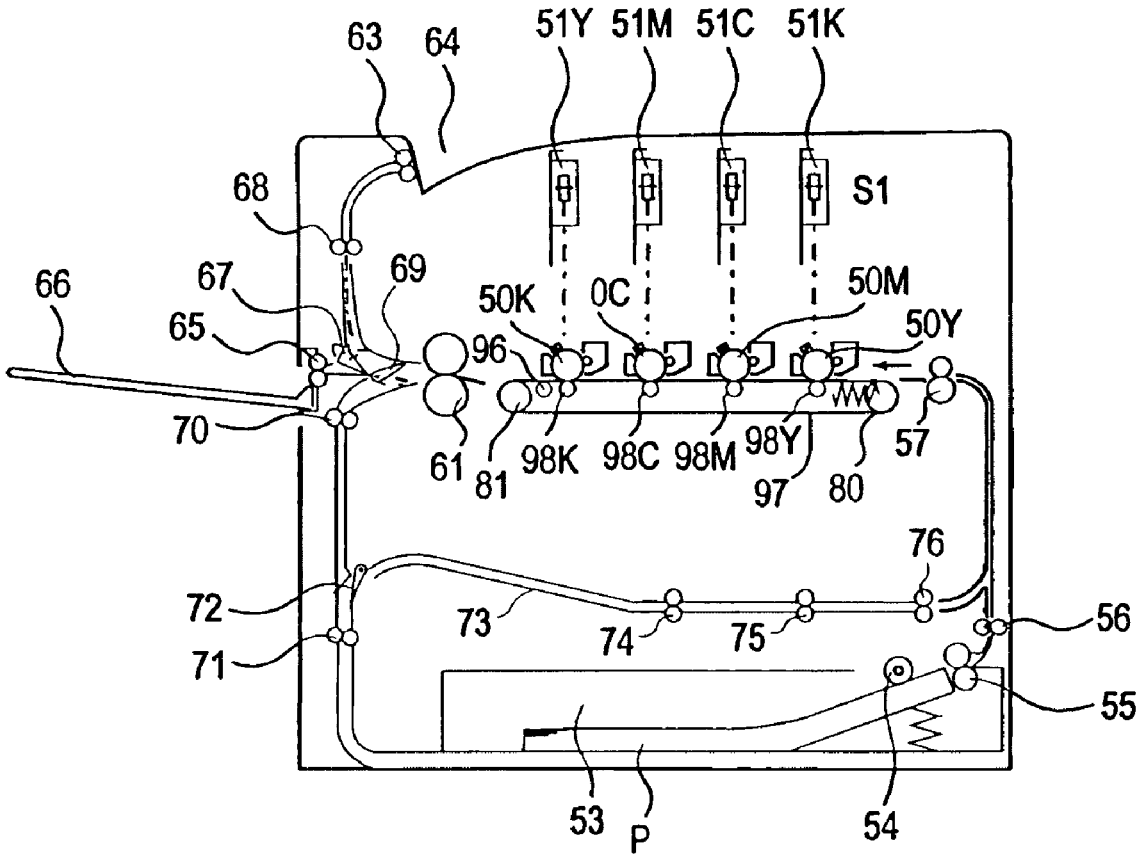
FIG. 12 is a sectional view of the image forming apparatus in the seventh embodiment of the present invention, which employs a transfer (conveyer) belt, and is equipped with an intermediary belt pressing roller, as belt pressing means (wrinkle blocking means), auxiliary to the transfer roller, describing the structures thereof.
Figure 13:
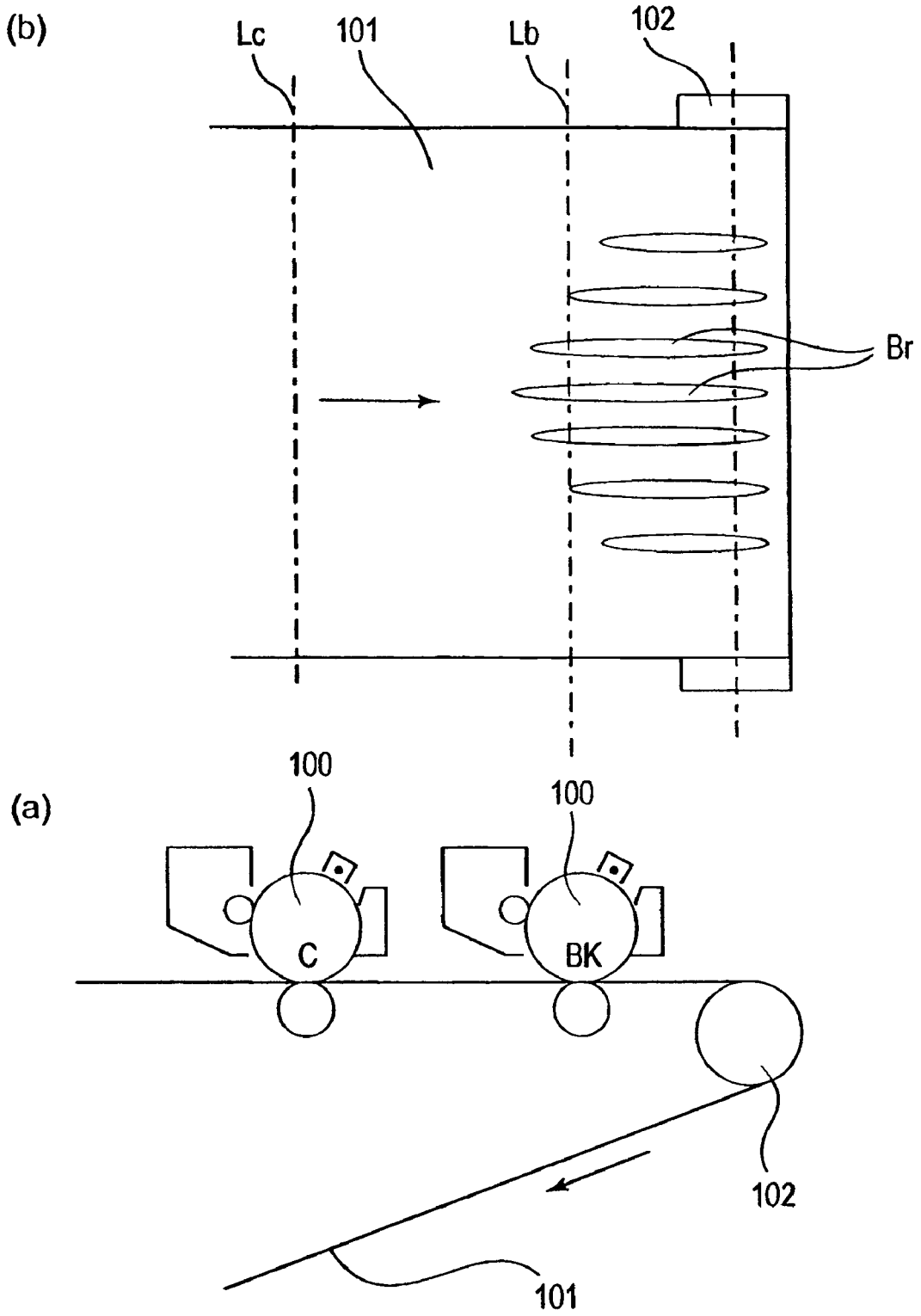
FIG. 13 PRIOR ART
FIG. 13 is a drawing for describing the wrinkles which occur in the intermediary transfer belt of an image forming apparatus in accordance with the prior art.

FIG. 12 is a sectional view of an image forming apparatus which employs a so-called transfer (conveyer) belt, and is characterized in that it is also provided with a roller 96 (auxiliary to primary transfer roller) as means for keeping the intermediary transfer belt 52 pressed outward in order to prevent the transfer (conveyer) belt from wrinkling. The roller 96 is the same in structure as the belt pressing roller 86 (wrinkle blocking roller) (auxiliary to the primary transfer roller) in the preceding embodiments, and also, is the same in function as the belt pressing roller 86 (wrinkle blocking roller) in the preceding embodiments. Further, the distance by which the transfer (conveyer) belt 97 is displaced outward by the belt pressing roller 96 (wrinkle blocking roller), and the structure for causing the belt pressing roller 96 to keep the transfer (conveyer) belt 97 pressed outward across the center portion of the transfer (conveyer) belt 97, are made comparable to the distance by which the intermediary transfer belt 52 is displaced outward by the belt pressing roller 86 (wrinkle blocking roller), and the structure for causing the belt pressing roller 86 (wrinkle blocking roller) to keep the intermediary transfer belt 52 pressed outward across the center portion of the intermediary transfer belt 52, in the preceding embodiments.

In other words, the seventh embodiment of the present invention is capable of effectively prevent the wrinkles formed in the transfer (conveyer) belt 97 by the driver roller 81, from extending into the adjacent image transfer station.

If wrinkles are generated in the transfer (conveyer) belt 97, gaps are generated between a transfer medium and transfer (conveyer) belt 97, and the toner images on the surface of the transfer medium are disturbed by the electric discharge which occurs across the gaps. However, this embodiment can effectively prevent the wrinkles of the transfer (conveyer) belt 97 attributable to the driver roller 82, from reaching the adjacent image forming station, preventing thereby the formation of a defective image.

Incidentally, the preceding embodiments of the present invention were described with reference to the image formation systems comprising multiple photosensitive members as image bearing members. Obviously, the present invention is also applicable to an image formation system comprising only a single photosensitive member, and the effects of such an application are comparable to those realized by the image forming apparatuses in the preceding embodiments.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 307157/2003 filed Aug. 29, 2003, which is hereby incorporated by reference.

What is claimed is:

1. An image forming apparatus comprising:

a plurality of image bearing members for carrying toner;

a rotatable endless belt for transferring the toner from said image bearing members onto a transfer material;

a plurality of transfer members for supplying an electric charge to a plurality of transfer areas of said belt for transferring the toner from respective ones of said image bearing members onto the transfer material;

a drive roller, contacted to said belt at a first contact area, for rotating said belt;

a driven roller, contacted to said belt at a second contact area, for supporting said belt, wherein said plurality of transfer areas are disposed between the first contact area and the second contact area which are adjacent to each other, and said plurality of transfer areas include a first transfer area which is a most downstream one of said transfer areas and which is closest to said first contact area; and an abutting member for abutting said belt being disposed at an abutting position which is downstream of said first transfer area and which is between said first transfer area and said first contact area with respect to a peripheral moving direction of said belt to bulge said belt in a direction from an inside surface of said belt toward an outside surface thereof at only a widthwise central portion of said abutting position.

2. The image forming apparatus according to claim 1, wherein said belt receives the toner from said image bearing members.

3. The image forming apparatus according to claim 1, wherein the toner is transferred from said image bearing members onto a transfer material carried on said belt.

4. The image forming apparatus according to claim 1, wherein said first driven roller is effective to expand said belt outwardly.

5. The image forming apparatus according to claim 1, wherein said abutting member is movable to be out of contact with said belt.

6. The image forming apparatus according to claim 1, wherein said abutting member includes a plurality of rotatable rollers, which are arranged in a direction substantially perpendicular to the movement direction of said belt.

7. An image forming apparatus comprising:

an image bearing member for carrying toner;

a rotatable endless belt for carrying toner;

a transfer member for constituting a transfer area and for supplying to said belt an electric charge for transferring the toner from said image bearing member onto said belt;

a drive roller, contacted to said belt at a first contact area, for rotating said belt;

a driven roller, contacted to said belt at a second contact area, for supporting said belt, wherein said transfer area is disposed between said first contact area and said second contact area which are adjacent to each other with respect to a circumferential direction of said belt as a single transfer area therebetween; and an abutting member for abutting said belt being disposed at an abutting position which is downstream of said transfer area and which is between said transfer area and said first contact area with respect to a peripheral moving direction of said belt to bulge said belt in a direction from an inside surface of said belt toward an outside surface thereof at only a widthwise central portion of said contact area, wherein said abutting member is a rotatable roller.

8. The image forming apparatus according to claim 7, wherein said driven roller is effective to expand said belt outwardly.

9. The image forming apparatus according to claim 7, wherein said abutting member is movable to be out of contact with said belt.

10. The image forming apparatus according to claim 7, wherein said abutting member includes a plurality of rotatable rollers, which are arranged in a direction substantially perpendicular to the movement direction of said belt.

* * * * *

UNITED STATES PATENT AND TRADEMARK OFFICE

CERTIFICATE OF CORRECTION

PATENT NO. : 7,415,232 B2
APPLICATION NO. : 10/924987
DATED : August 19, 2008
INVENTOR(S) : Norio Matsui et al.

It is certified that error appears in the above-identified patent and that said Letters Patent is hereby corrected as shown below:

TITLE PAGE [56] References Cited, OTHER PUBLICATIONS:

"11052759, Feb. 26, 1999." should read --11-52759, Feb. 26, 1999.--; "11288136, Oct. 19, 1999." should read --11-288136, Oct. 19, 1999.--; and "2002182494, June. 26, 2002." should read --2002-182494, Jun. 26, 2002.--.

COLUMN 1:

Line 57, "circularity" should read --circularly--.

COLUMN 3:

Line 59, "electric" should read --an electric charge--.

COLUMN 6:

Line 31, "sheets." should read --sheets--.

COLUMN 10:

Line 44, "unstableness" should read --instability--.

COLUMN 16:

Line 37, "include" should read --includes--.

Signed and Sealed this

Twenty-fourth Day of February, 2009

JOHN DOLL
*Acting Director of the United States Patent and Trademark Office*